US007422448B2

(12) United States Patent
Brandenburg et al.

(10) Patent No.: US 7,422,448 B2
(45) Date of Patent: Sep. 9, 2008

(54) SURFACE MOUNT CONNECTOR

(75) Inventors: Scott D. Brandenburg, Kokomo, IN (US); Thomas A. Degenkolb, Noblesville, IN (US); Matthew R. Walsh, Sharpsville, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/191,864

(22) Filed: Jul. 28, 2005

(65) Prior Publication Data

US 2007/0026700 A1 Feb. 1, 2007

(51) Int. Cl.
*H01R 12/00* (2006.01)

(52) U.S. Cl. ..... 439/83

(58) Field of Classification Search ..... 439/83, 439/936, 876, 140

See application file for complete search history.

(56) References Cited

U.S. PATENT DOCUMENTS

| | | | | |
|---|---|---|---|---|
| 3,241,095 | A * | 3/1966 | Phillips | 439/199 |
| 5,735,697 | A * | 4/1998 | Muzslay | 439/83 |
| 5,893,765 | A * | 4/1999 | Farnworth | 439/91 |
| 6,208,515 | B1 * | 3/2001 | Klein | 361/704 |
| 6,380,621 | B1 * | 4/2002 | Ando et al. | 257/707 |
| 6,472,724 | B1 * | 10/2002 | Matsuzawa et al. | 257/659 |
| 6,500,027 | B1 * | 12/2002 | Van Der Sanden et al. | 439/587 |
| 6,504,105 | B1 * | 1/2003 | Acocella et al. | 174/255 |
| 6,510,195 | B1 * | 1/2003 | Chappo et al. | 378/19 |
| 6,660,560 | B2 | 12/2003 | Chaudhuri et al. | |
| 6,693,239 | B2 | 2/2004 | Myers et al. | |
| 6,790,051 | B1 * | 9/2004 | Secall et al. | 439/78 |
| 6,972,958 | B2 * | 12/2005 | Mayer | 361/719 |
| 7,093,358 | B2 * | 8/2006 | Akram et al. | 29/874 |
| 2003/0131476 | A1 * | 7/2003 | Ocher et al. | 29/890.03 |
| 2004/0027769 | A1 * | 2/2004 | Denison et al. | 361/118 |
| 2005/0093181 | A1 * | 5/2005 | Brandenburg et al. | 257/796 |
| 2006/0028288 | A1 * | 2/2006 | Langhorn et al. | 333/22 R |

* cited by examiner

*Primary Examiner*—Tulsidas C Patel
*Assistant Examiner*—Phuong Nguyen
(74) *Attorney, Agent, or Firm*—Jimmy L. Funke

(57) ABSTRACT

A surface mount connector and assembly including the surface mount connector is shown and described. The assembly comprises a substrate and a connector including a carrier, and at least one electrical connecting element having first and second ends, wherein at least a portion of the first end extends through the carrier to electrically adjoin and physically secure the connector to the substrate. A reinforcement medium is disposed about at least a portion of surface mount connector and said substrate.

21 Claims, 4 Drawing Sheets

SURFACE MOUNT CONNECTOR

TECHNICAL FIELD

The present invention relates to a connector and, more particularly, to a surface mount connector.

BACKGROUND

Through-hole connectors are traditionally used to provide product connecter headers in many applications. Conventional through-hole connection technology provides increased reliability and robustness and, accordingly, through-hole connectors are traditionally utilized in environments that demand reliability. Among others, the automotive industry, often utilizes through-hole connectors for circuit boards, as the demand for reliability in an automobile is generally high.

Conventional through-hole attachment techniques typically require a process to attach the connector to the substrate such as, for example and without limitation, a selective wave solder process or a pin and paste process. In addition, as substrates often include multiple layers, the through-hole connector often consumes valuable substrate real estate. This real estate could otherwise be used, for example and without limitation, to provide additional electrical pathways and the like through the substrate and mounting of electrical components on the surface of the opposing side of the substrate To help minimize or eliminate the consumption of such real estate; attempts have been made to replace the through-hole connectors with various surface mount connector assemblies. However, many surface mount connector assemblies generally compromise product reliability as they often malfunction due to lost, or otherwise broken, electrical or physical connections between the substrate and the connector. Such malfunctions arise, for example, due to cracks or the like arising between the connector and the substrate. Such malformations are typically the result of a mechanical overstress, or a coefficient of thermal expansion mismatch between the connector and the substrate.

SUMMARY

A surface mount connector and assembly including the surface mount connector is shown and described. The assembly comprises a substrate and a connector including a carrier, and at least one electrical connecting element having first and second ends, wherein at least a portion of the first end extends through the carrier to electrically adjoin and physically secure the connector to the substrate. A reinforcement medium is disposed about at least a portion of the connector and the substrate.

BRIEF DESCRIPTION OF THE DRAWINGS

Embodiments of the invention will now be described, by way of example, with reference to the accompanying drawings, wherein.

DETAILED DESCRIPTION

Figure 1:
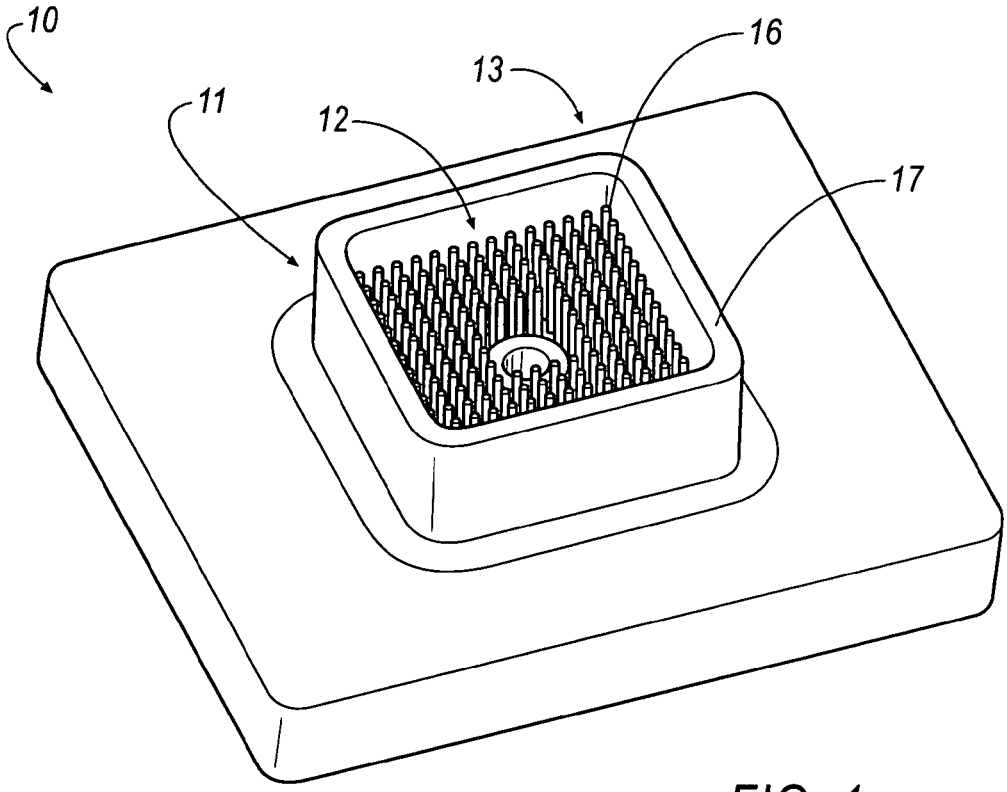
FIG. 1 is an isometric view of a surface mount connector assembly mounted on a substrate according to an embodiment of the invention.

Referring to FIG. 1, a surface mount connector assembly is shown generally at 10 according to an embodiment of the present invention. The illustrated system comprises a surface mount connector 11 and a substrate 13. Surface mount connector 11 includes a connection sub-assembly 12 and is configured to generally attach surface mount connector 11 to substrate 13. In an embodiment, connection sub-assembly 12 electrically adjoins and mechanically attaches surface mount connector 10 to substrate 13.

With reference to FIGS. 2A-4 connection sub-assembly 12 may include a carrier 14 and at least one connecting element 16. Among other possibilities, connecting element 16 will be hereinafter referred to as pin 16, however, one skilled in the art will recognize that other possible connecting elements may be integrated into the system and the invention discussed should not be so limited thereby. For example, connecting element 16 may be a solder ball or the like. It will be appreciated that a shroud 17 or the like may house connection sub-assembly 12 to generally shield connection sub-assembly 12 from externalities including, for example, other elements or the like resident on substrate 13.

Figure 2A:
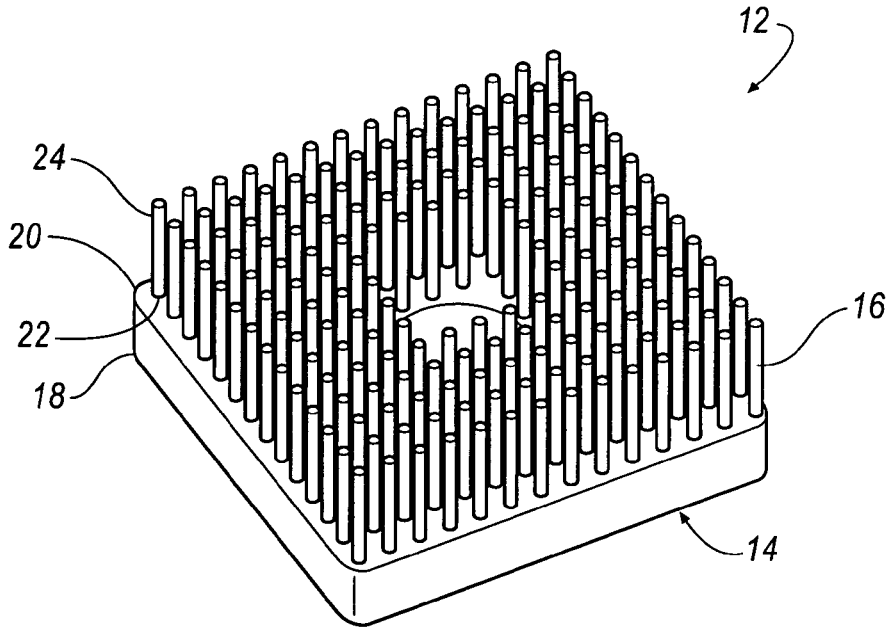
FIG. 2A is an isometric view of a connection sub-assembly according to an embodiment of the invention.
Figure 2B:
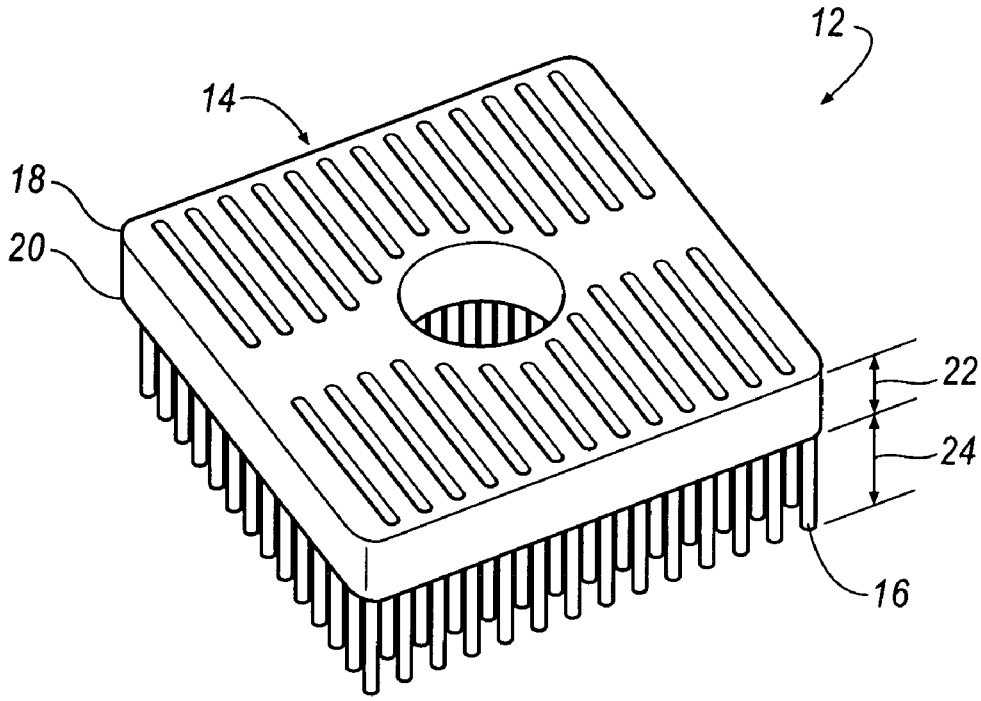
FIG. 2B is an isometric view of a connection sub-assembly according to an embodiment of the invention.
Figure 2C:
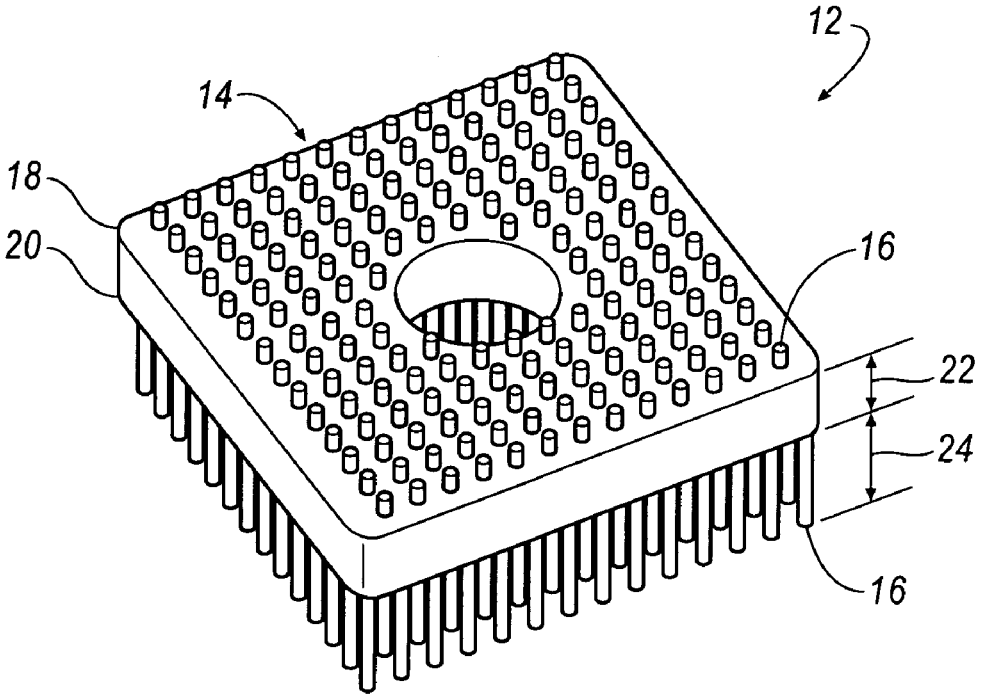
FIG. 2C is an isometric view of a connection sub-assembly according to an embodiment of the invention.

In an embodiment, carrier 14 includes a proximal side 18 and a distal side 20, and connecting element 16 includes a first end portion 22 and a second end portion 24. First end portion 22 of pin 16 may be adjacent to (as shown in FIG. 2B) or extend beyond (as shown in FIG. 2C) proximal side 18 of carrier 14. Second portion 24 may extend from distal side 20 of carrier 14. First end portion 22 may be adapted to attach, electrically or otherwise, pin 16 to substrate 13. In an embodiment, at least a portion of first end portion 22 of pin 16 may extend through carrier 14 so that carrier 14 forms a common base. Carrier 14 may comprise a ferrous material and form a ferrite block which acts as an inductor to reduce electromagnetic emissions. Moreover, chip capacitors or the like may also be attached to the pin carrier board for additional electromagnetic interference filtering. It will be appreciated, that carrier 14 may comprise other similar materials, and these materials will be readily recognized by one of ordinary skill in the art. It should further be noted, that pins 16 may be arranged and commonly grouped to electrically connect to common portions of substrate 13 (as shown in FIG. 2B) or pins 16 may each individually be arranged to connect with individual portions of substrate 13 (as shown in FIG. 2C). These and other features will be readily recognized by one of ordinary skill in the art without deviating from the present disclosure.

In an embodiment, second portion 24 of pin 16 may remain generally unencumbered and, therefore, may be used to attach, electrically or otherwise, substrate 13 to an external element (not shown) through surface mount connector 11 and surface mount connector assembly 10. Thus, pin 16 may provide an unencumbered attachment means between external element (not shown) and substrate 13. Also, pin 16 may be generally comprised of conductive material to form an electrical pathway to substrate 13. These and other similar features of carrier 14 and pin 16 will be recognized by one of skill in the art.

Figure 3:
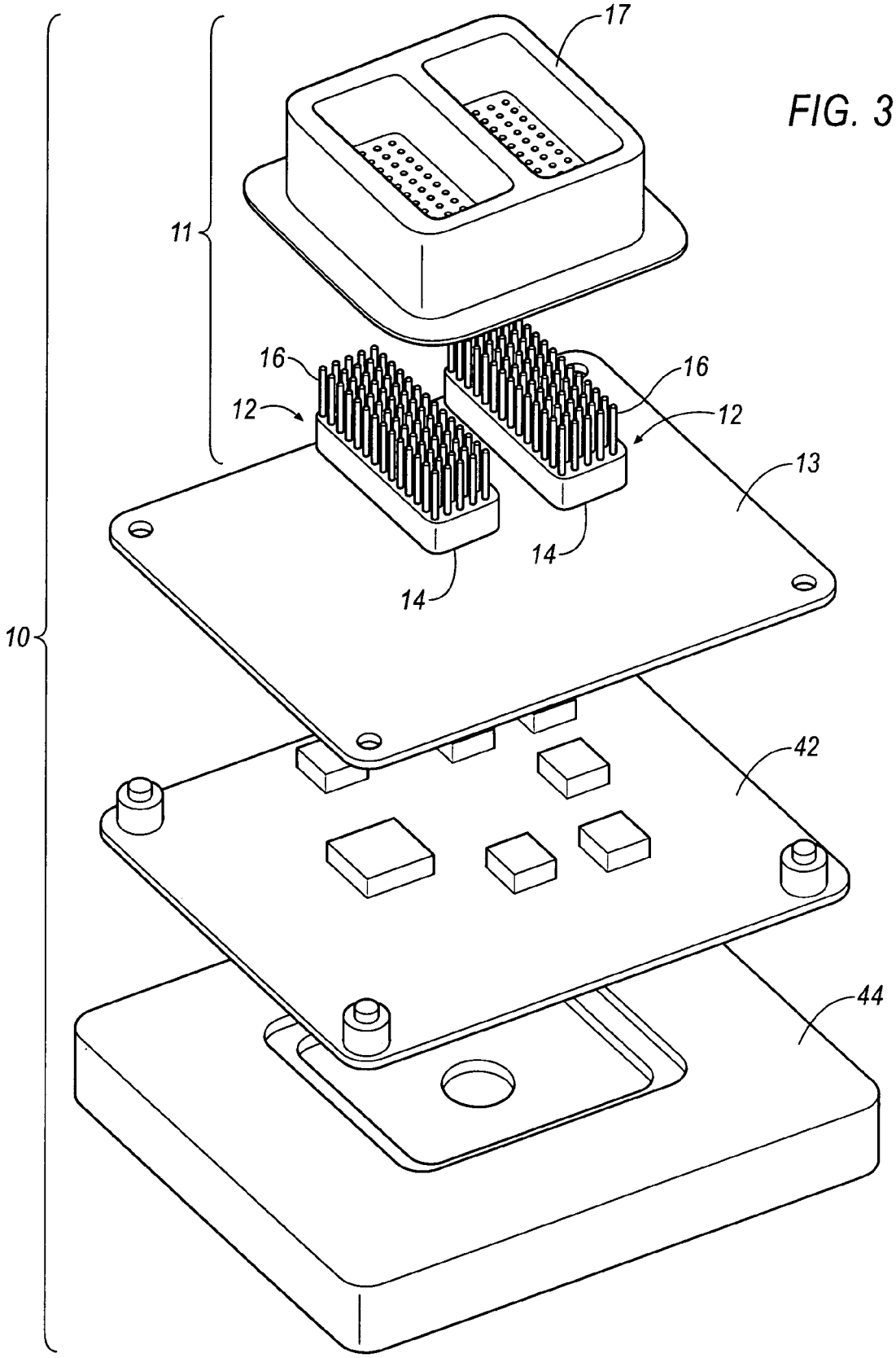
FIG. 3 is a connector assembly according to an embodiment of the invention.
Figure 4:
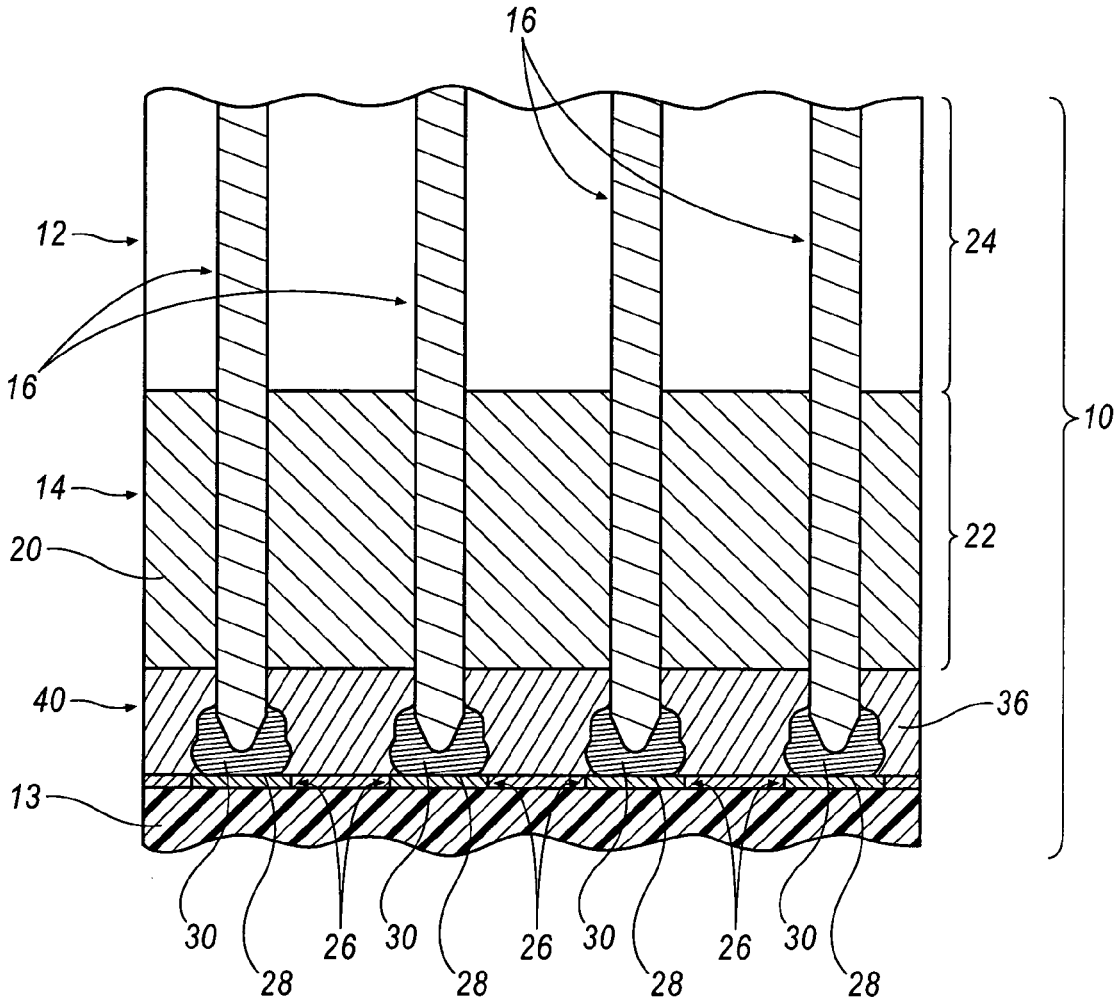
FIG. 4 is a partial cross-sectional view of the connector assembly from FIG. 3 mounted on a substrate according to an embodiment of the invention.

As shown in FIG. 1, FIG. 3 and FIG. 4, surface mount connector 10 mechanically and electrically mounts to a surface of substrate 13. In an embodiment, substrate 13 may include at least one connector receiving portion 26 to provide means to mechanically and electrically adjoin substrate 13 with surface mount connector 11 to form surface mount connector assembly 10. Among other possibilities, connector receiving portion 26 may be a solder bond pad 28 that corresponds to pin 16 of surface mount connector 11.

In an embodiment, pin 16 may further include a solder portion 30, such as a solder ball or the like. Solder portion 30 may be arranged along at least a portion of first end portion 22 of pin 16 such that, upon applying heat or the like, for example, as applied during a reflow process, solder portion 30 provides a bond or the like between pin 16 and solder band pad 28. It will be appreciated, that structures, other than solder balls and solder bond pads 28 may be used to form the bond between pin 16 and receiving portion 26. For example, among other possibilities, pin 16 may be stamped, drawn or include a solder bump to provide the connection to connector receiving portion 26 during the reflow process.

In accordance with the present invention, receiving portion 26 is attached to pin 16, electrically or otherwise, and provides an electrical pathway to attach an external element (not shown) to substrate 13. In an embodiment, substrate 13 includes a plurality of conductive traces (not shown) to provide conductive pathways to provide signal transfer between external element, pin 16 and substrate 13. Among other possibilities, substrate 13 may be a laminate circuit board (as shown in FIG. 4) or any other suitable circuit board material known in the art. Other possibilities will be recognized by one of skill in the art and may be appropriately substituted therefore.

The traces (not shown) may be comprised of metal or an alloy, however, one skilled in the art will readily recognize substitute substrates or trace materials. It will also be appreciated that other connection elements, other than solder bond pad 28, may be used to mount surface mount connector 10 to substrate 13 and the present invention should not be limited to solder bond pad 28.

With continued reference to the Figures, a reinforcement layer 36 may be applied over at least a portion of surface mount connector 11 and substrate 13. In accordance with the invention, reinforcement layer 36 further secures the connection between substrate 13 and surface mount connector 10 to provide further stability and reliability to the connection. In an embodiment, reinforcement layer 36 may bond surface mount connector 11 to substrate, to a laminate layer resident on substrate 13 or both. Reinforcement layer 36 may be disposed between a portion of substrate 13 and a portion of connection sub-assembly 12 such that reinforcing layer 36 generally encapsulates at least one of the connections therebetween. Additionally, reinforcement layer 36 may be applied over surface mount connector 10 and substrate 13 such that reinforcement layer 36 is molded thereover.

Reinforcement layer 36 may comprise a non-conductive polymer to form a polymeric body or the like. Among other possibilities, reinforcement layer 36 comprises an epoxy resin. It will be appreciated that the polymeric body may have a coefficient of thermal expansion to generally match the coefficient of thermal expansion of at least a portion of substrate 13, pin 16 and/or connection sub-assembly 12. For example, inorganic filler or the like may be added to the polymer to generally match the coefficient of thermal expansion as described. It will be appreciated, that reinforcement layer 36 may provide added electromagnetic interference filtering and one of ordinary skill in the art will readily recognize the benefits provided therefrom.

Among other possibilities, reinforcement layer 36 may be applied to the assembly as an underfill layer, an overmold layer or both. With reference to the underfill layer, substrate 13 and sub-assembly 12 are generally spaced apart and define a gap 40 therebetween. The underfill layer may be disposed about at least a portion of gap 40.

Referring to FIG. 3, a back plate 42 or the like may be provided for attaching substrate 13 thereto. Further, reinforcement layer 36 is illustrated as an overmold material 44 to generally encapsulate surface mount connector 10 and substrate 13. It will be appreciated that various combinations of the structures herein disclosed may be used to apply surface mount connector 10 to substrate 13 without deviating from the present disclosure provided the assembly includes surface mount connector 10, substrate 13 and reinforcement layer 36.

In an embodiment, and as described hereinabove, reinforcement layer 36 may comprise an underfill layer. Underfill layer may be disposed about at least a portion of gap 40 through an injection process, a capillary process or a no-flow process. Underfill layer may bond with at least one of substrate 13, laminate thereon and at least a portion of surface mount connector 10. These and other processes to dispose or apply underfill material as a reinforcing layer 36 will become obvious to one of ordinary skill in the art after considering the present disclosure. It will also be appreciated, that reinforcement layer 36 may be a single layer or multiple layers and the invention should not limited to the disclosed number of layers.

The invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. An assembly comprising:

a substrate;

a connector attached to the substrate, said connector including a carrier spaced apart from the substrate defining a gap therebetween, and at least one electrical connecting element having first and second ends, wherein at least a portion of said first end extends beyond a proximal side of the carrier facing the substrate, the first end of the at least one electrical connecting element being soldered to the substrate to electrically adjoin and physically secure said connector to the substrate, and wherein the second end of the at least one electrical connecting element extends beyond a distal side of the carrier opposite the proximal side of the carrier for attachment of an external element; and a non-conductive reinforcement consisting of a medium disposed only between said carrier and said substrate.

2. The assembly in accordance with claim 1, wherein said reinforcement layer is adapted to generally encapsulate the connection between said at least one electrical connecting element and said substrate.

3. The assembly in accordance with claim 1, wherein said reinforcing medium is polymeric.

4. The assembly in accordance with claim 1, wherein said reinforcing medium is an epoxy resin.

5. The assembly from claim 1, wherein said substrate includes at least one solder bond pad to electrically receive and physically secure said at least one electrical connecting element.

6. The assembly in accordance with claim 1, wherein said at least one electrical connecting element is at least one of a stamped pin and a drawn pin.

7. The assembly in accordance with claim 1, wherein said reinforcement medium is at least one of an overmold or an underfill.

8. The assembly in accordance with claim 1, wherein said reinforcing medium is disposed using at least one of an injected underfill, capillary underfill or no-flow underfill.

9. The assembly in accordance with claim 1, further comprising a plurality of connecting elements and wherein the plurality of connecting elements are arranged in an array and extend generally perpendicular to the carrier and the substrate.

10. The assembly in accordance with claim 1, wherein said reinforcement layer bonds with at least one of the substrate and the carrier.

11. The assembly of claim 1, wherein the carrier is a ferrous material which acts as an inductor to reduce electromagnetic emissions.

12. A microelectronic assembly comprising:

a substrate having a surface that includes solder bond pads;

a pin array sub-assembly having a carrier and a plurality of connector pins extending through the carrier, the carrier having a first side facing the substrate spaced apart by a gap and a second side opposite the first side, each of said connector pins having a first end portion in coordination with said first side of said carrier and a free end portion extending from the second side of said carrier;

a plurality of interconnections, each said interconnections adjoining said first end portion of said pin to said bond pad of said substrate; and a polymeric body disposed only within the gap to attach the carrier to the substrate and to reinforce at least one of the interconnections.

13. The microelectronic assembly in accordance with claim 12, wherein the substrate comprises a generally planar surface, and wherein the carrier comprises a polymeric plate substantially parallel to said planar surface.

14. The microelectronic assembly in accordance with claim 12, wherein the connector pins are arranged in an array and extend generally perpendicular to the substrate.

15. The microelectronic assembly in accordance with claim 12, wherein polymeric body includes an epoxy resin.

16. The microelectronic assembly in accordance with claim 12, wherein the polymeric body bonds with at least one of said substrate and said pin-array sub-assembly.

17. The microelectronic assembly in accordance with claim 12, wherein the polymeric body is an overmolded thermoset epoxy.

18. A method for attaching a connector having a carrier to a substrate, said method comprising the steps of:

providing a connector including a carrier having a proximal side and an opposite distal side, a plurality of electrical connecting elements extending through the carrier, each of the plurality of electrical connecting elements having a first end extending beyond the proximal side of the carrier and a second end extending beyond the distal side of the carrier for attachment of an external element;

arranging the first ends of the plurality of electrical connecting elements with a plurality of corresponding connection points of the substrate, the resulting arrangement defining a gap between the substrate and the carrier;

soldering the plurality of pins to the corresponding connection points; and disposing a non-conductive reinforcement material consisting of a medium disposed only between said carrier and said substrate.

19. The method according to claim 18, wherein said step for reinforcing further comprises:

dispensing a polymeric material only in a gap between the carrier and the substrate, the polymeric material generally reinforcing the solder connection between the plurality of pins and the corresponding connection points such that the polymeric material extends about the carrier to bond at least a portion of the carrier to at least a portion of the substrate.

20. The method according to claim 19, wherein said step of dispensing further includes an underfill process.

21. The method according to claim 20, wherein said underfill process is performed using at least one of a injection process, a capillary process or a no-flow process.

* * * * *